US007959087B2

(12) United States Patent
Tarr

(10) Patent No.: US 7,959,087 B2
(45) Date of Patent: Jun. 14, 2011

(54) MODEL RAILROAD TRACK CONNECTOR

(76) Inventor: Robert J. Tarr, Willoughby, OH (US)

( * ) Notice: Subject to any disclaimer, the term of this patent is extended or adjusted under 35 U.S.C. 154(b) by 273 days.

(21) Appl. No.: 11/951,734

(22) Filed: Dec. 6, 2007

(65) Prior Publication Data

US 2008/0135637 A1 Jun. 12, 2008

Related U.S. Application Data

(60) Provisional application No. 60/873,688, filed on Dec. 8, 2006.

(51) Int. Cl.
*E01B 23/00* (2006.01)

(52) U.S. Cl. ..... 238/10 E; 238/10 R; 238/10 A; 238/10 C; 267/166; 267/167

(58) Field of Classification Search ..... 267/166, 267/167, 170, 174, 179; 238/10 R, 10 E, 238/10 A, 10 C, 10 F, 151
See application file for complete search history.

(56) References Cited

U.S. PATENT DOCUMENTS

| | | | | | |
|---|---|---|---|---|---|
| 1,023,416 | A | * | 4/1912 | Orosbie | 152/93 |
| 1,277,850 | A | * | 9/1918 | Campbell | 152/105 |
| 1,610,770 | A | * | 12/1926 | Greene | 267/74 |
| 1,679,911 | A | * | 8/1928 | Moffitt | 238/10 R |
| 1,857,764 | A | * | 5/1932 | Nygard | 267/166 |
| 2,084,322 | A | * | 6/1937 | Crane | 238/10 E |
| 2,120,251 | A | * | 6/1938 | Johnson | 238/10 E |
| 2,181,954 | A | * | 12/1939 | Wallat | 267/170 |
| 2,290,584 | A | * | 7/1942 | Gardner et al. | 238/10 R |
| 2,368,775 | A | * | 2/1945 | Perret | 74/581 |
| 2,565,359 | A | * | 8/1951 | Dubilier | 238/10 R |
| 2,651,826 | A | * | 9/1953 | Carpenter et al. | 248/507 |
| 3,158,392 | A | * | 11/1964 | Shell | 292/288 |
| 3,372,458 | A | * | 3/1968 | Bradford | 29/271 |
| 3,618,214 | A | * | 11/1971 | Armstrong | 433/19 |
| 3,620,451 | A | | 11/1971 | Richter | |
| 4,223,834 | A | | 9/1980 | Fechter | |
| 4,225,081 | A | | 9/1980 | Ikegame | |
| 4,666,194 | A | * | 5/1987 | Charman | 292/288 |
| 4,709,856 | A | * | 12/1987 | Rother et al. | 238/10 E |
| 4,898,326 | A | | 2/1990 | Edwards et al. | |
| 4,993,631 | A | | 2/1991 | Niehoff | |
| 5,160,091 | A | * | 11/1992 | Hesse | 238/10 E |
| 5,503,330 | A | * | 4/1996 | Riley | 238/10 E |
| 5,690,278 | A | | 11/1997 | Grubb | |
| 5,779,145 | A | | 7/1998 | Zelle et al. | |

(Continued)

FOREIGN PATENT DOCUMENTS

EP 0 370 579 A2 5/1990

(Continued)

*Primary Examiner* — S. Joseph Morano
*Assistant Examiner* — Jason C Smith
(74) *Attorney, Agent, or Firm* — Fay Sharpe LLP

(57) ABSTRACT

An auxiliary model railroad track connector for adjoining railroad track sections is provided. Each railroad track section including an array of ties and a pair of rails positioned in a spaced apart relationship on the array of ties. The auxiliary model railroad track connector includes a first end section and a second end section. The first and second end sections are coupled to opposing ties of the adjoining track sections. A resilient member is interposed between the first and second end sections. The resilient member has sufficient pulling force to hold and pull the adjoining track sections together. The auxiliary connector prevents longitudinal movement between the adjoining railroad tracks sections and maintains mechanical and electrical connections between the railroad track sections.

15 Claims, 11 Drawing Sheets

U.S. PATENT DOCUMENTS 6,109,599 A * 8/2000 Kringel ..... 267/179
6,123,298 A * 9/2000 Riley ..... 246/415 A
6,398,120 B1 6/2002 Klein
6,435,421 B1 * 8/2002 Peterson ..... 238/10 R
6,648,237 B2 11/2003 Rothkopf et al.
6,857,666 B1 * 2/2005 Ashlock ..... 285/146.1
2005/0167517 A1 8/2005 Webster et al.
2008/0135637 A1 * 6/2008 Tarr ..... 238/10 E

FOREIGN PATENT DOCUMENTS

GB 2 035 105 6/1980

* cited by examiner

MODEL RAILROAD TRACK CONNECTOR

CROSS REFERENCE TO RELATED APPLICATIONS

This application claims priority from U.S. Provisional Patent Application Ser. No. 60/873,688 filed Dec. 8, 2006, which is expressly incorporated herein by reference, in its entirety.

BACKGROUND

The present disclose generally relates to model railroad tracks and specifically to a separate model railroad track connector which securely holds two sections of model railroad track together.

Hobby enthusiasts for many years have enjoyed the operation of model railroad trains of the type in which separate track sections are removably joined together to form a closed path designed by the hobbyist over which a model train will travel. Sectional model railroad track has been constructed in a variety of forms and gauges (typical gauges being Standard, G, 0, S, HO, TT, N, and Z). In the simplest form, a section of track includes a pair of spaced apart, electrically conductive rails and an arrangement of ties extending between the rails, the rails being joined together to form the track section into the desired configuration, i.e., straight, or curved with a variety of radii. The rails form a closed electrical circuit when the track sections are joined together in a closed configuration or pattern. Means are provided for supplying electrical energy to the rails of the assembled track sections to energize the model train traveling thereon. It is therefore of significant importance that the individual joined track sections be securely locked together to establish firm engagement and contact between the respective electrical connectors to assure that electrical current and mechanical reliability for smooth wheel travel will be continuously delivered to the model train during operation of the model railroad set.

In the past, model railroad sets have employed so-called track connectors, fishplates or rail joiners to assure electrical continuity between different track sections joined together. The rail joiners are effectively metal pieces extending from the ends of the conductive rails of the individual track sections for assuring electrical contact between the rails of the adjacent track sections removably joined together. The rail joiners take the form of a thin piece of metal, which is formed substantially into a C-shape, and which is placed on the rail extending under the bottom side thereof and around a flange at the base of the rail. Such rail joiners provide adequate mechanical and electrical connections when the track sections are mounted on a solid surface.

The rail joiners are rather delicate objects, particularly in the smaller track gauges (HO scale and smaller). The rail joiners are frequently secured to the rails, one rail joiner being secured to one of the rails at one end of the section and another rail joiner being secured to the opposing rail at the other end of the section. The rail joiners extend beyond the ends of the rails, and as such, are subject to impact which may result in disfiguration, following which the rail joiners may not be operational to join sections of tracks and to provide an electrical connection therebetween. When such railroad track is assembled and disassembled, there is frequently lateral movement of the track sections relative to one another. This results in an enlargement of the rail joiner, which in turn results in poor mechanical and electrical connection between track sections upon reassembly. Poor mechanical and electrical connection between track sections will result in poor operation of the model trains which are run on the track.

Aside from the common and traditional use of the above rail joiners, another approach to the problem of maintaining constant and continuous connection has been to attach an auxiliary and augmenting connector to the track assembly itself. One such design comprises thin metal joints which connect directly onto the rails. Such joints provide additional connection but have the same tendency as other metal products to bend out of the original shape and to lose the close contact as the rails are wiggled in and out. Another design comprises elongated U-shaped metal clamps to join the track sections. A flat, elongated section of the clamp lies beneath each rail section of two adjoining track sections, while a U-shaped clamp parts extend upwards between the ties to hold the rails. The limited design of this clamp will only allow for use with track section of a particular base design and with particular railroad tie spacing. Further, the prior art connectors do not allow for rail expansion and/or contraction.

Accordingly, the present invention provides a new and improved model railroad track connector which overcomes certain difficulties with the prior art designs and is suitable for coupling together two lengths of model railroad track of any form and gauge.

BRIEF DESCRIPTION

In accordance with one aspect of the present disclosure, an auxiliary model railroad track connector for adjoining railroad track sections is provided. Each railroad track section including an array of ties and a pair of rails positioned in a spaced apart relationship on the array of ties. The auxiliary model railroad track connector comprises a first end section and a second end section. The first and second end sections are coupled to opposing ties of the adjoining track sections. A resilient member is interposed between the first and second end sections. The resilient member has sufficient pulling force to hold and pull the adjoining track sections together. The auxiliary connector prevents longitudinal movement between the adjoining railroad tracks sections and maintains mechanical and electrical connections between the railroad track sections.

In accordance with another aspect of the present disclosure, an auxiliary model railroad track connector for adjoining first and second opposing railroad track sections comprises a first end section and a second end section. The first end section is mounted to one of the ties of the first track section and the second end section being mounted to an opposing tie of the second track section. A resilient member is interposed between and connected to the first and second end sections. The resilient member includes a bottom surface which is located above a lowermost portion of each of the first and second end sections.

In accordance with yet another aspect of the present disclosure, an auxiliary model railroad track connector comprises a first end section and a second end section. A helical spring is interposed between the first and second end sections. The first and second end sections are located in a common plane.

Still other aspects of the present disclosure will become apparent from a reading and understanding of the detailed description of the several embodiments described hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the disclosure.

DETAILED DESCRIPTION

Figure 1:
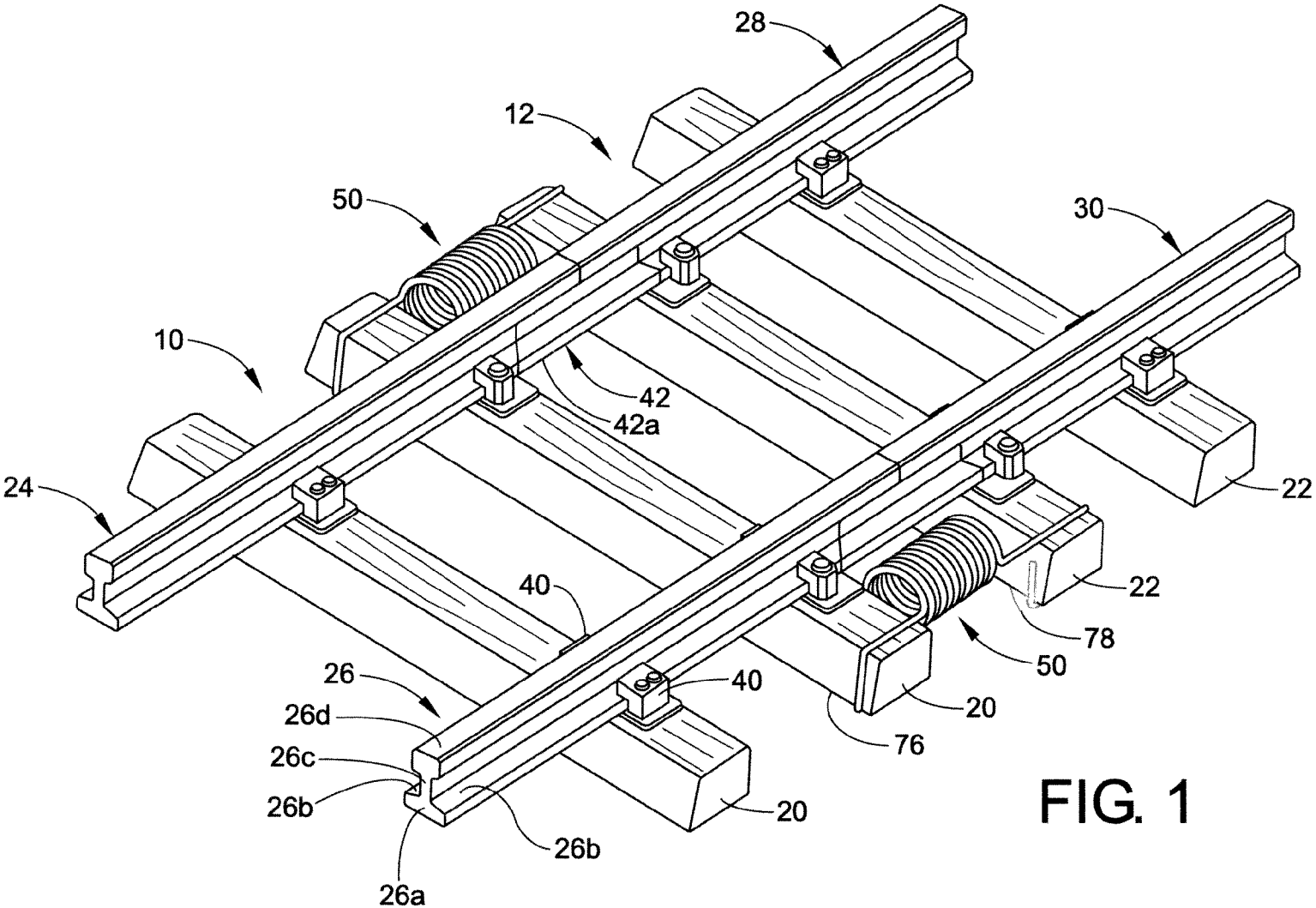
FIG. 1 is a perspective view of two model railroad track sections incorporating a separate track connector according to a first embodiment of the present disclosure.

It should, of course, be understood that the description and drawings herein are merely illustrative and that various modifications and changes can be made in the structures disclosed without departing from the scope and spirit of the present disclosure. All references to direction and position, unless otherwise indicated, refer to the orientation of the model railroad track and connector illustrated in the drawings and should not be construed as limiting. It will also be appreciated that the various identified components of the model railroad track and auxiliary connector disclosed herein are merely terms of art that may vary from one model railroad track manufacturer to another and should not be deemed to limit the present invention.

Figure 2:
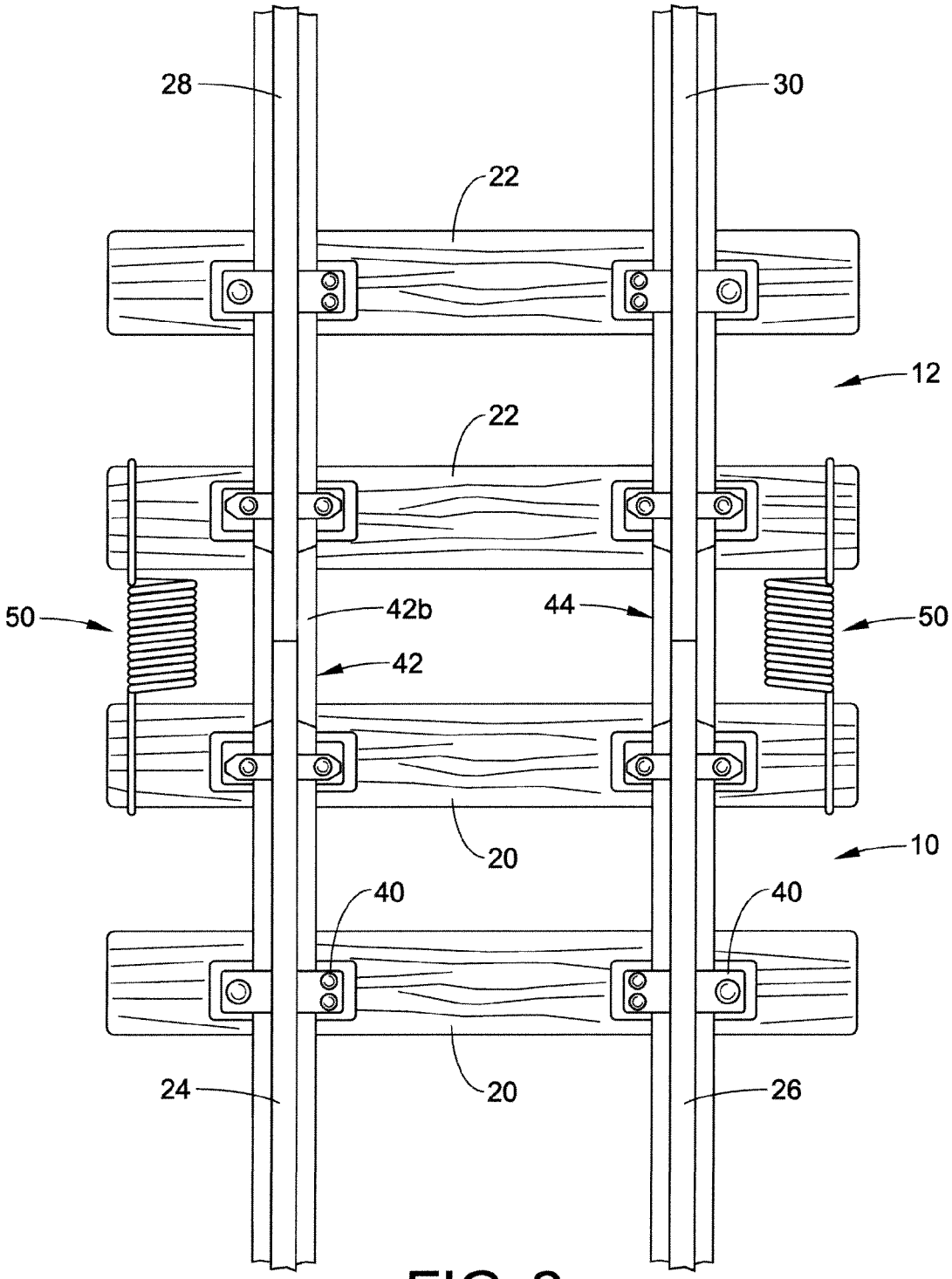
FIG. 2 is a top plan view of the track sections of FIG. 1.

Referring now to the drawings, wherein like numerals refer to like parts throughout the several views, FIGS. 1 and 2 illustrate portions of two pieces of sectional model railroad track 10 and 12. In the depicted embodiment, each section of track includes an array 20, 22 of model railroad ties. Rails 24, 26, 28, and 30 are positioned in a spaced apart relationship on tie arrays 20, 22, respectively. The rails are electrically conductive and are generally formed from brass or nickel-silver alloy. Each rail generally includes a base, such as 26*a*, having flanges 26*b* extending from either side thereof. The base and flanges generally rest on the ties. A central web 26*c* extends upward from the base and connects with a rail head 26*d*.

Referring again to FIGS. 1 and 2, the rails are generally secured to the ties by means of rail spikes 40 which extend over the rail flanges to hold the rails 24, 26, 28, and 30 on the respective ties 20, 22. In this embodiment, the tie array and spikes are formed in an injection molding process and the rails are inserted between the spikes on top of the ties with the spike heads extending over the flanges. Although, it should be appreciated that alternate means for attaching the rails to the ties are also contemplated.

Fishplates or rail joiners 42, 44 are secured to the ends of rails 24, 30, respectively. The rail joiners may be permanently attached, as by soldering, or may be frictionally, removably secured. The rail joiners are typically C-shaped having a connecting web, such as 42*a*, joining to curved portions 42*b* which extend around the rail flanges. When the track sections 10, 12 are to be joined, their ends are aligned and the rails 24, 26, 28, and 30 are joined by sliding the rail joiners over the opposing rail. Particularly, as shown in FIGS. 1 and 2, rail joiner 42 slides over and grips the rail flanges of rail 28 and rail joiner 44 slides over and grips the rail flanges of rail 26. The rail joiners are generally formed of thin metal plate of the same type of metal used to form the rails. Further details of the above track sections 10 and 12 are generally conventional and understood by one skilled in the art so that further discussion herein is deemed unnecessary.

As indicated previously, the rail joiners 42, 44 ensure good alignment of the rails and provide adequate mechanical and electrical connections when the track sections 10, 12 are mounted on a solid surface. However, this is not the case when the track is roughly handled, subjected to repeated assembly and disassembly or laid on a non-solid surface, such as a graduated trestle or a carpet. Further, the rail joiners are not intended to provide a physical restraining system for the track, and, although the rail joiners can prevent lateral movement of track sections relative to one another, they will do very little to prevent longitudinal movement which is required to keep the track sections from separating from one another.

Figure 3:
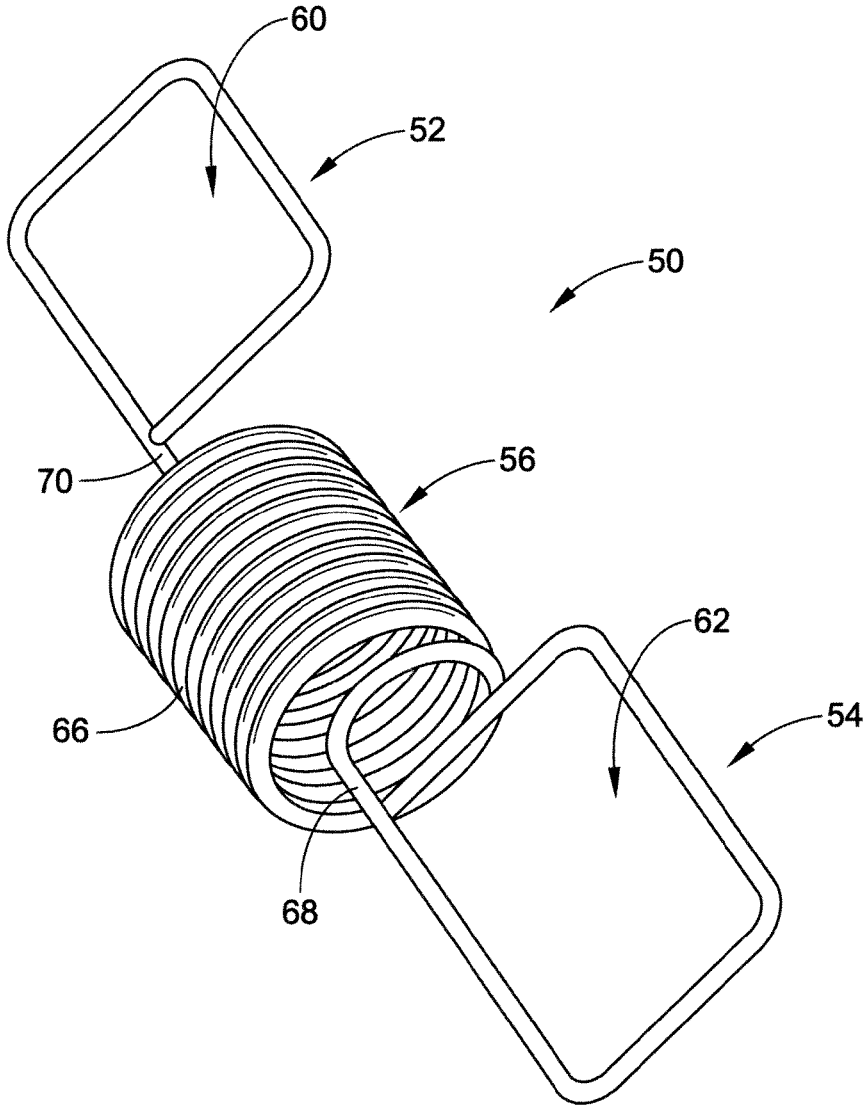
FIGS. 3 and 4 are perspective views of the track connector of FIG. 1.
Figure 4:
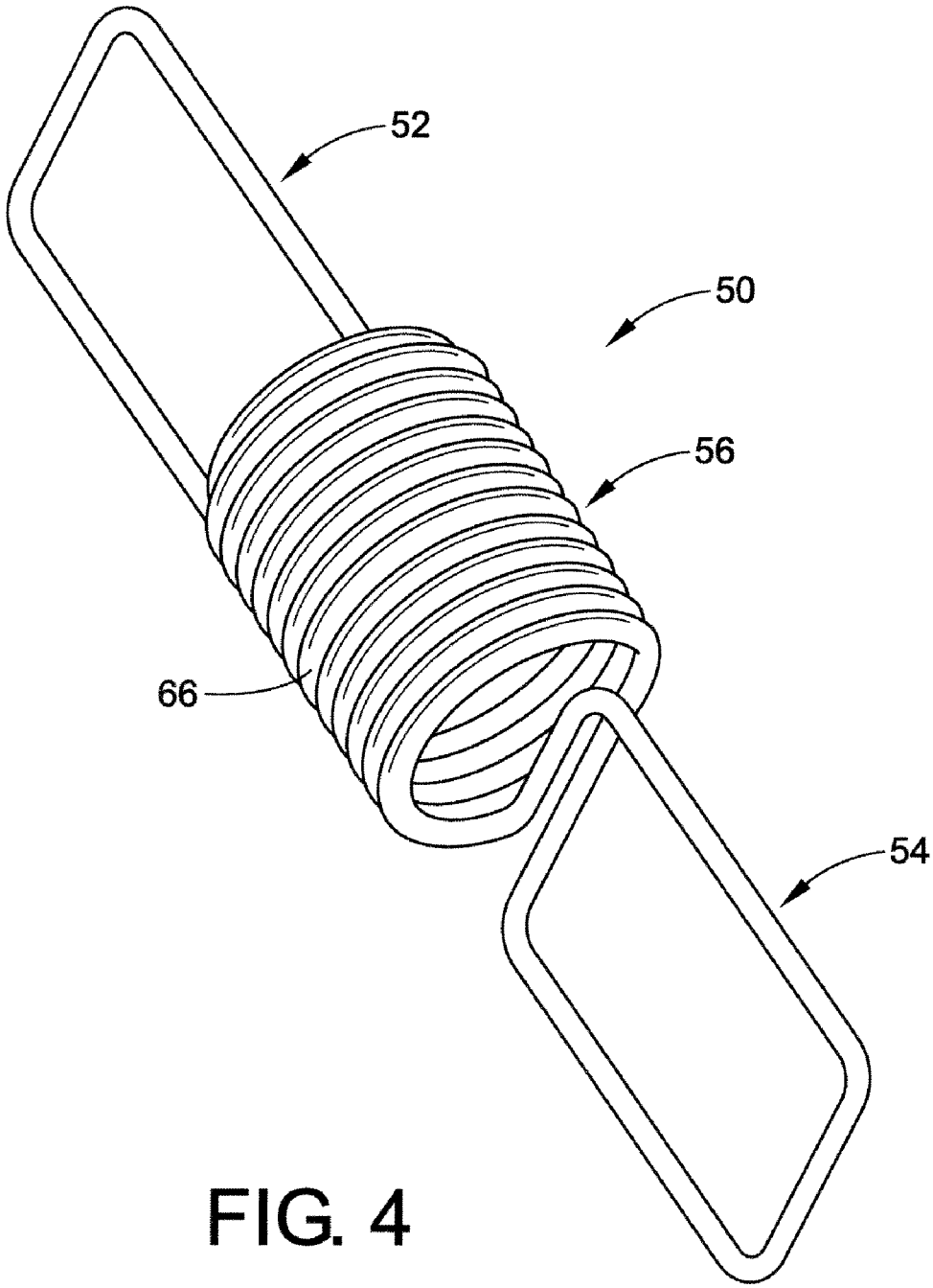

With continued reference to FIGS. 1 and 2, to prevent such longitudinal movement, separate, auxiliary track connectors 50, according to a first embodiment of the present disclosure, are coupled to the opposing ties 20, 22 of the respective track sections 10, 12. Although two connectors 50 are shown, both connectors are not required to maintain mechanical and electrical connections between the track sections. As shown in FIGS. 3 and 4, the track connector 50 includes first and second end sections 52 and 54, each conformed to the profile of a railroad tie, and a resilient member 56 interposed therebetween. The resilient member, which has sufficient pulling force to hold and/or pull the two track sections together, allows for use of the connector 50 with track sections of no particular design, gauge and/or particular railroad tie spacing. In the depicted embodiment, the connector is in the form of an extension spring which exerts a pulling force or energy. Each end section 52, 54 is generally rectangular shaped and includes an opening 60, 62 configured to receive an end of a tie. Although, it should be appreciated that the alternative shapes, such as a hook, are also contemplated. The openings can be dimensioned to frictionally receive the tie ends; although, this is not required. The resilient member 56 is a closely wound helical spring 66 having end sections 68, 70 connected to the respective first and second end sections 52, 54. As best shown in FIG. 2, a longitudinal axis defined by the helical spring is offset from a common planed defined by the first and second end sections. In the depicted embodiment, once attached to the opposed rails, the longitudinal axis of the helical spring is closer to the rail joiner than the first and second end sections 52, 54. Although, it should be appreciated that the first and second end sections can be closer to the rail joiner than the helical spring. Once connected to the track sections, the connector 50 does not interfere with the passage of a model train (not shown) along the rails 24, 26, 28, and 30. Equally, since the helical spring 66 is raised above a respective bottom surface 76, 78 of each tie 20, 22, the track sections 10, 12 are able to rest flush on generally flat solid surfaces. This also allows for the placement of ballast (i.e., stone) between the ties.

Figure 5:
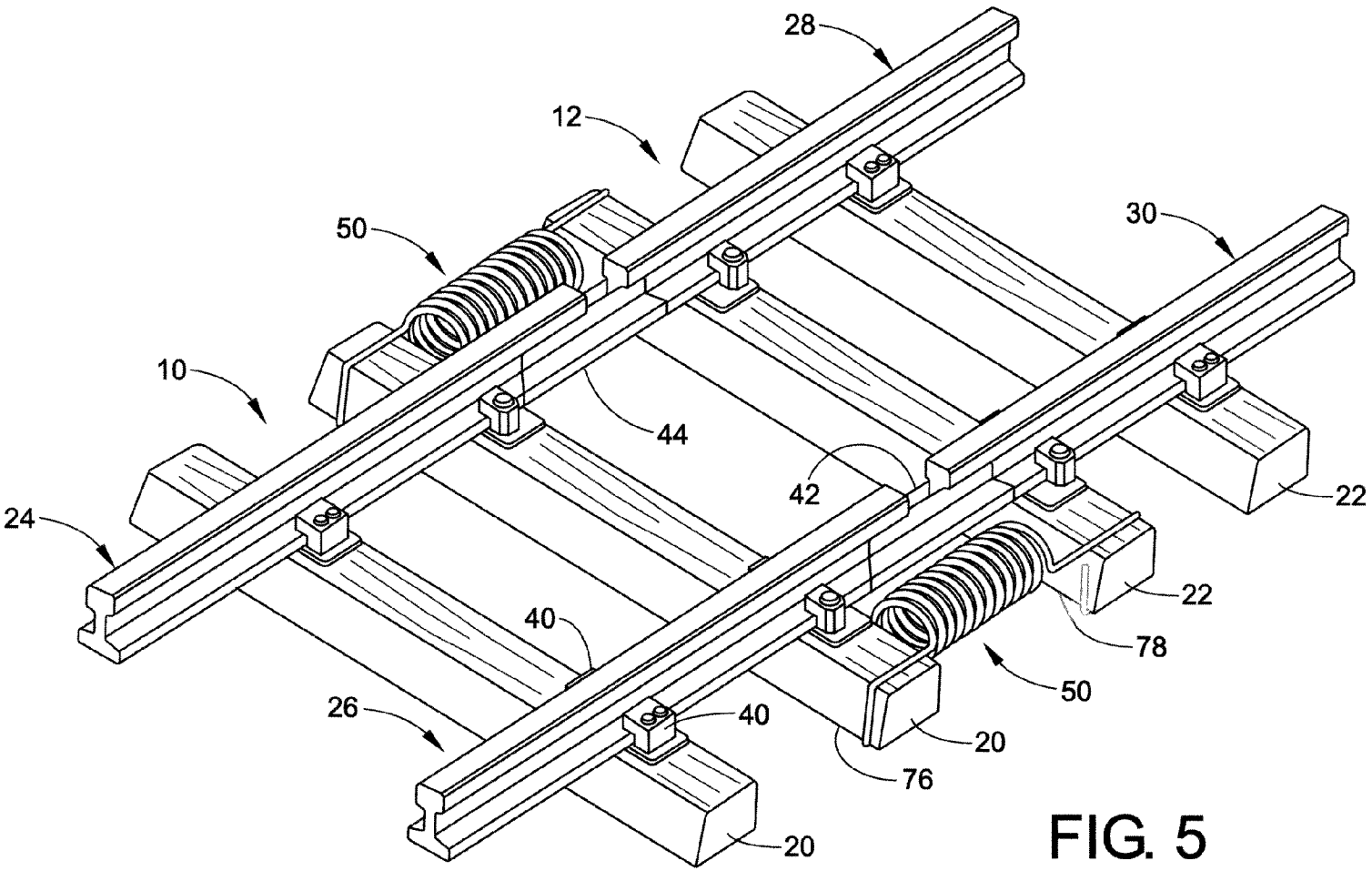
FIG. 5 is a perspective view of the track sections of FIG. 1 at least partially pulled apart.
Figure 6:
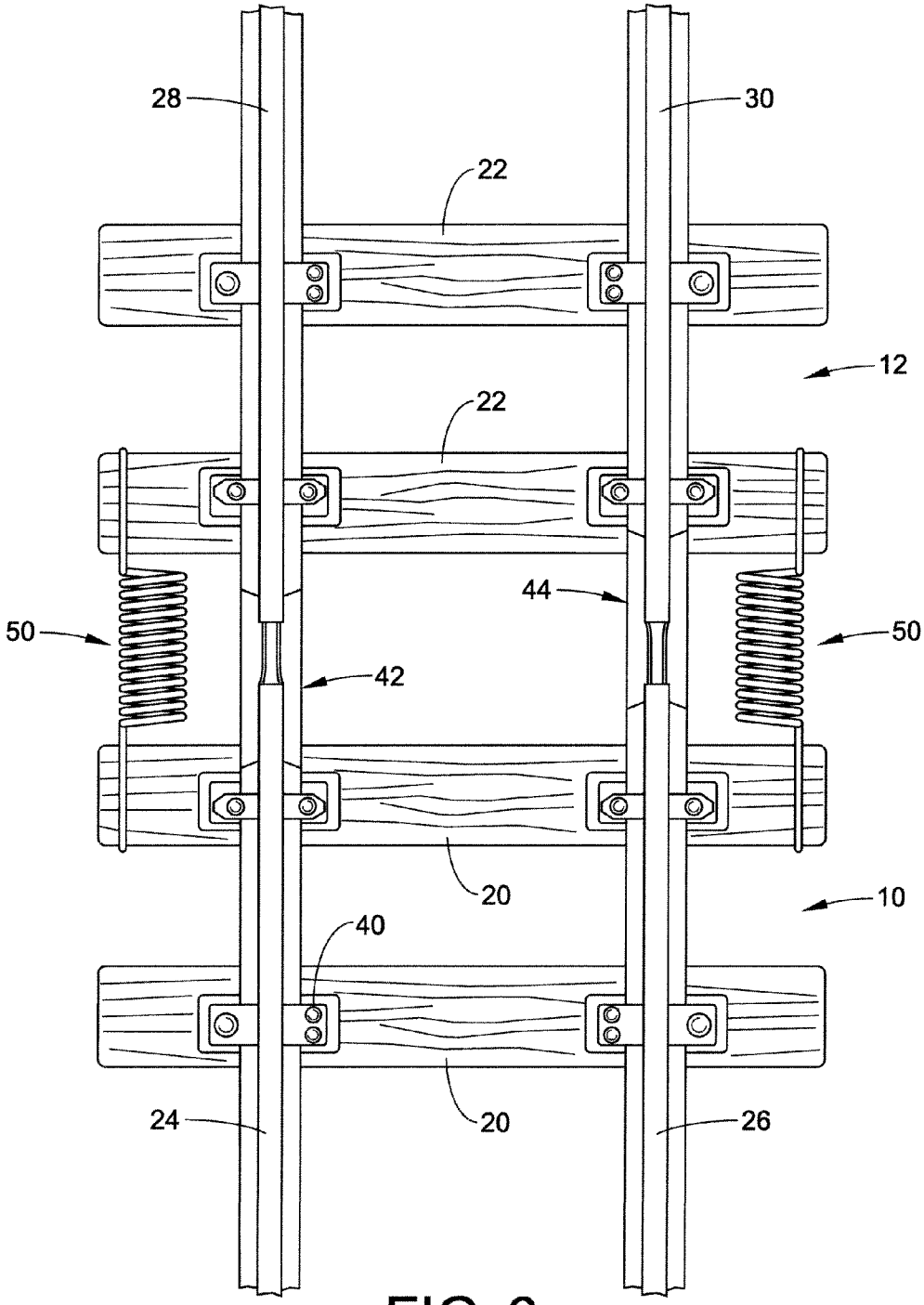
FIG. 6 is a top plan view of the track sections of FIG. 2 at least partially pulled apart.

During operation of the model railroad set, the two track sections 10, 12 can move apart, for example, by the mechanical vibrations caused by the model train (as shown in FIGS. 5 and 6). Although the initial tension (i.e., the force that tends to keep the coils of an extension spring closed and which must be overcome before the coils start to open) of the helical spring 66 can be exceeded by the mechanical vibrations, the track connector 50 has sufficient pulling force to hold and/or pull the two track sections together. This ensures a continuous and constant mechanical and electrical connection without which a model train will cease running or may derail. The track connector 50 is generally formed of stainless steel wire; although, it should be appreciated that the connector can be formed from other suitable materials, such as brass, steel, aluminum and composite fiber.

Figure 8:
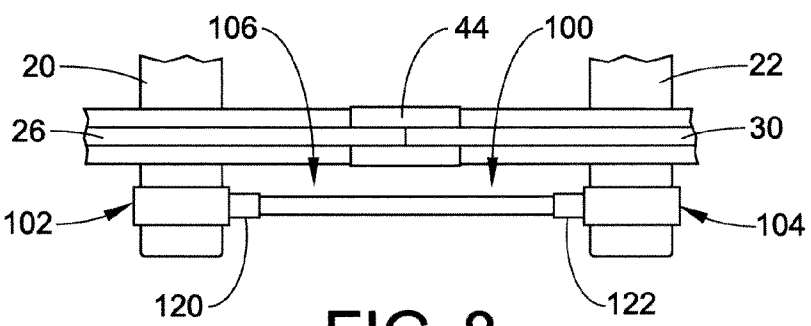
FIGS. 7 and 8 are respective side elevational and top plan views of a track connector according to a second embodiment of the present disclosure.
Figure 7:
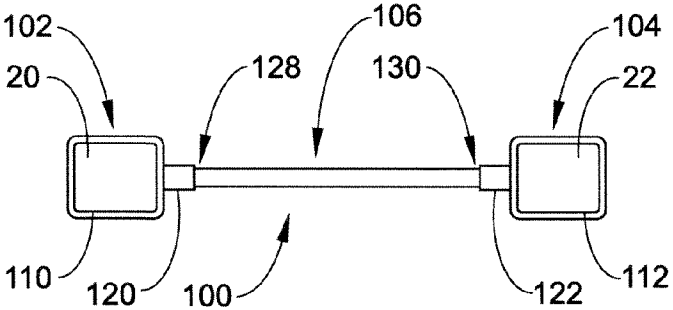

With reference to FIGS. 7 and 8, a second embodiment of a track connector 100 for maintaining mechanical and electrical connection between opposing track sections is shown. The connector 100 includes first and second end sections 102 and 104, each conformed to the profile of a railroad tie, and a resilient member 106 therebetween. Each end section 102, 104 is generally rectangular-shaped and includes an opening 110, 112 dimensioned to receive an end section of one of the opposing railroad ties 20, 22. Sockets 120, 122 are connected to the respective first and second end sections. The resilient member is made from an elastomeric material and spans between the sockets. End sections 128, 130 of the resilient member are secured in openings (not shown) located in the sockets.

Figure 10:
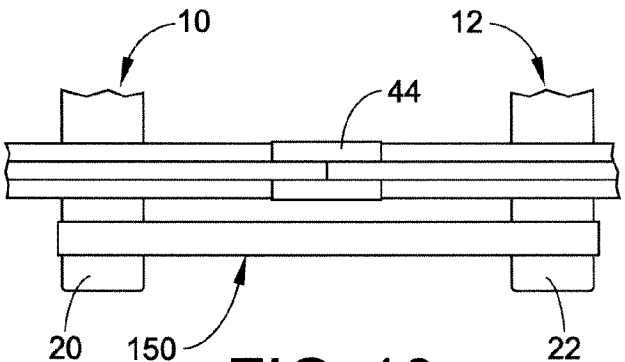
FIGS. 9 and 10 are respective side elevational and top plan views of a track connector according to a third embodiment of the present disclosure.
Figure 9:
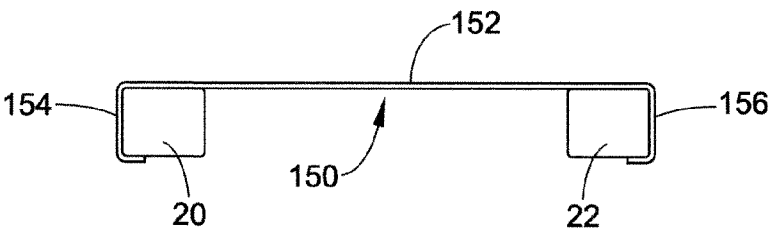

With reference to FIGS. 9 and 10, a third embodiment of a track connector 150 for maintaining mechanical and electrical connection between opposing track sections is shown. A flat, elongated section 152 of the connector 150 lies above the ties of the two adjoining track sections 10, 12. First and second hooked-shaped end sections 154 and 156, respectively, of the connector are coupled to the ties 20, 22. The design of this connector is generally for use with track section of a particular design and with particular tie spacing. The connector 150 can be made from an elastomeric material.

Figure 12:
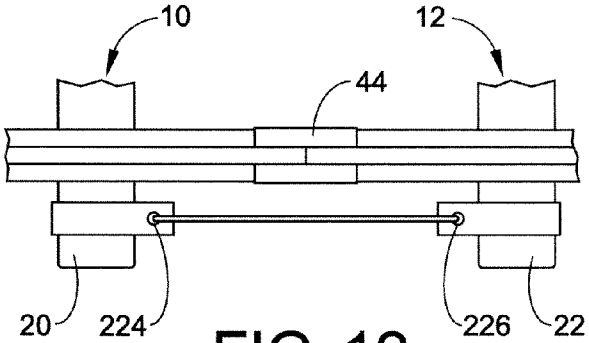
FIGS. 11 and 12 are respective side elevational and top plan views of a track connector according to a fourth embodiment of the present disclosure.
Figure 11:
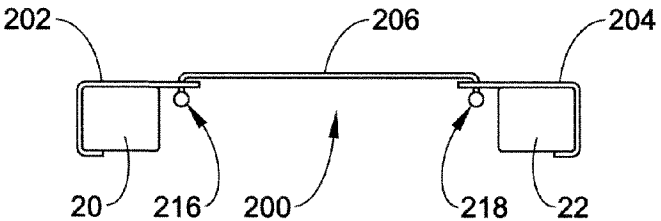

With reference to FIGS. 11 and 12, a fourth embodiment of a track connector 200 for maintaining mechanical and electrical connection between opposing track sections is shown. The connector 200 includes first and second hooked-shaped end sections 202 and 204, and a resilient member 206 therebetween. The hooked-shaped end sections are connected to respective end sections of the opposing railroad ties 20, 22. The resilient member is made from an elastomeric material and includes ball-shaped end sections 216 and 218, respectively. The ball-shaped end sections are secured in respective openings 224, 226 located in the first and second end sections 202, 204. It should be appreciated that other means for securing the resilient member to the end sections are also contemplated.

Figure 14:
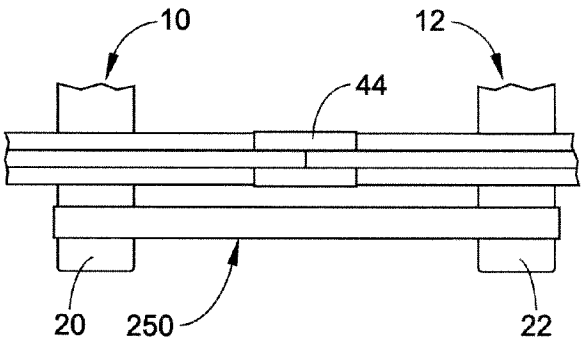
FIGS. 13 and 14 are respective side elevational and top plan views of a track connector according to a fifth embodiment of the present disclosure.
Figure 13:
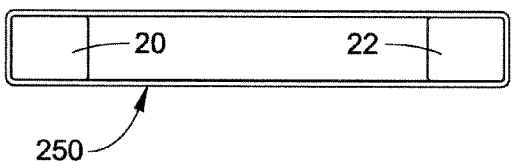

With reference to FIGS. 13 and 14, a fifth embodiment of a track connector 250 for maintaining mechanical and electrical connection between opposing track sections is shown. The connector 250 is an elastomeric band which is mounted over the opposing ties 20, 22.

Figure 16:
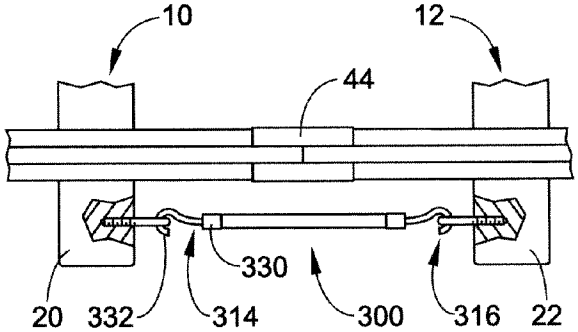
FIGS. 15 and 16 are respective side elevational and top plan views of a track connector according to a sixth embodiment of the present disclosure.
Figure 15:
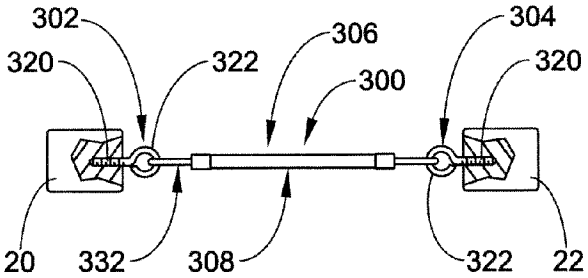

With reference to FIGS. 15 and 16, a sixth embodiment of a track connector 300 for maintaining mechanical and electrical connection between opposing track sections is shown. The connector 300 includes a pair of fastening elements 302, 304 and a resilient member 306 therebetween. The resilient member includes an elastomeric member 308 and connecting elements 314, 316 mounted to end portions of the elastomeric element. The connecting elements are coupled to the fastening elements. As shown, each fastening element has a screw-like section 320, which is threadedly secured to an end section of one of the ties 20, 22, and an eyelet 322. Each connecting element has a socket 330 including an opening (not shown) for receiving the end portion of the elastomeric element and a hooked-shaped member 332 extending from the socket for attaching to the eyelet.

Figure 18:
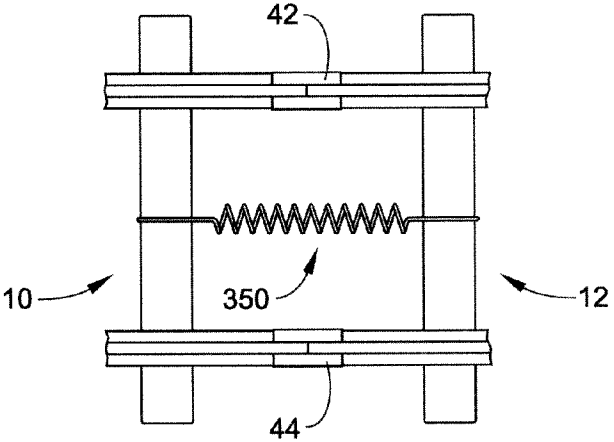
FIGS. 17 and 18 are respective side elevational and top plan views of a track connector according to a seventh embodiment of the present disclosure.
Figure 17:
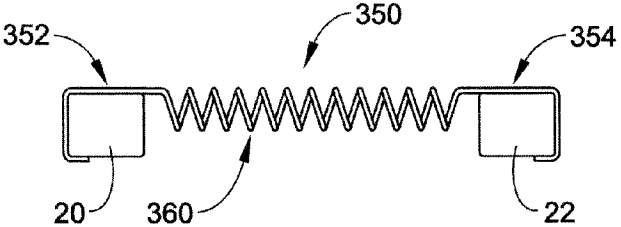

With reference to FIGS. 17 and 18, a seventh embodiment of a track connector for maintaining mechanical and electrical connection between opposing track sections is shown. The connector 350, which is also in the form of an extension spring, includes hooked-shaped end sections 352, 354 and a helical spring 360 therebetween. As shown, the connector can be mounted to the ties 20, 22 of track sections 10, 12 between the track rails. Similar to the previous embodiments, the connector can also be mounted to end sections of the ties 20, 22.

Figure 19:
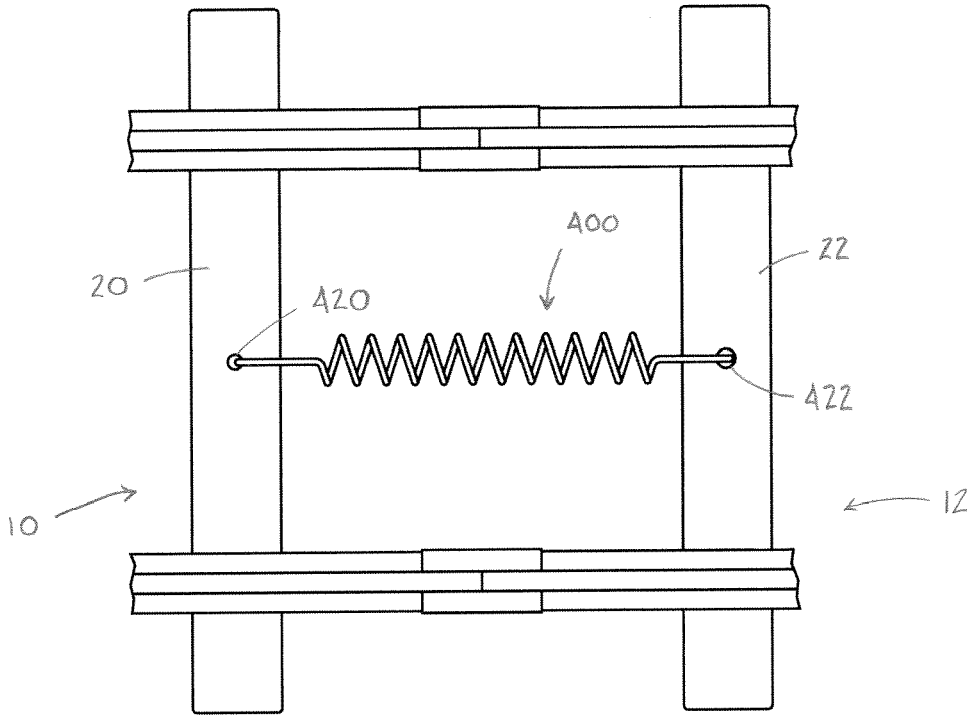
FIG. 19 is a top plan view of a track connector according to an eighth embodiment of the present disclosure connected to adjoining model railroad track sections.
Figure 20:
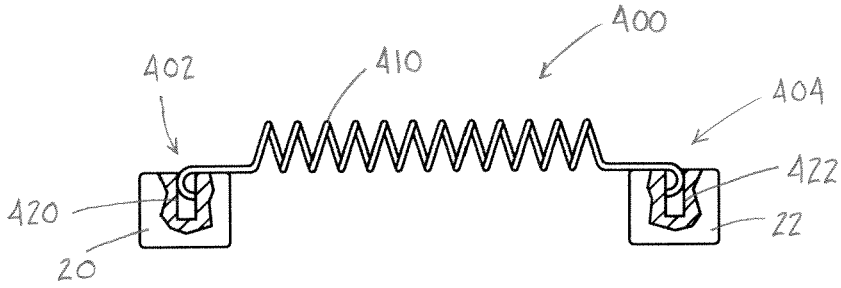
FIG. 20 is a side elevational view, partially broken away, of FIG. 19.
Figure 21B:
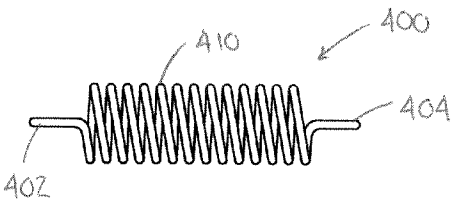
FIG. 21B is a top plan view of the track connector of FIG. 21A.
Figure 21A:
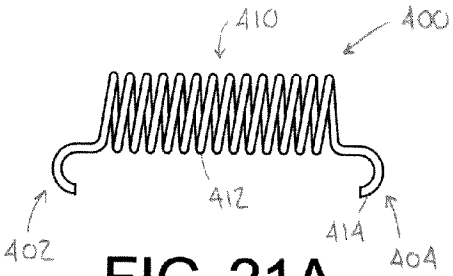
FIG. 21A is a side elevational view of the track connector of FIG. 19.
Figure 21C:
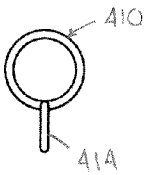
FIGS. 21C-21E are alternative front views of the track connector of FIG. 21A.
Figure 21D:
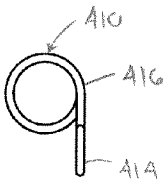
Figure 21E:
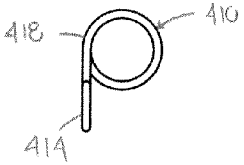

With reference to FIGS. 19-21B, an eighth embodiment of a track connector 400 for maintaining mechanical and electrical connection between opposing track sections is shown. The connector 400, which is also in the form of an extension spring, includes downwardly extending hooked-shaped end sections 402, 404 and a resilient member or helical spring 410 therebetween. The end sections are mirror images of each other and face towards the helical spring. As shown in FIG. 21A, the helical spring 410 includes a bottom surface 412 which is located above a lowermost portion 414 of each of the end sections. As shown in FIGS. 21B and 21C, a common plane defined by the end sections 402, 404 generally bisects the helical spring. Alternatively, as shown in FIGS. 21D and 21E, the end sections are located in a common plane tangent to one of the side surfaces 416, 418 of the helical spring. With reference to FIGS. 19 and 20, the connector 400 can be mounted to the ties 20, 22 of track sections 10, 12, for example, between the track rails. Specifically, each tie 20, 22 can include an opening 420, 422, which can extend at least partially through the tie. As illustrated, the openings are located between the rails; although, this is not required. The hook-shaped end-sections 402, 404 are dimensioned to be received in the openings 420, 422.

Figure 22A:
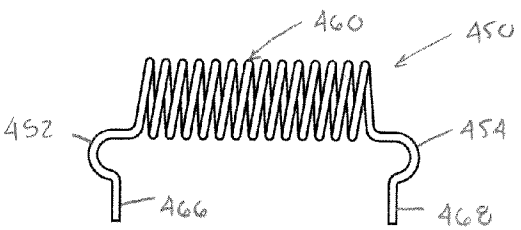
FIG. 22A is a side elevational view of a track connector according to a ninth embodiment of the present disclosure.
Figure 22B:
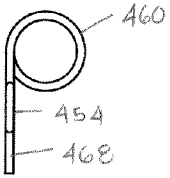
FIG. 22B is a front view of the track connector of FIG. 22A.

With reference to FIGS. 22A and 22B, a ninth embodiment of a track connector 450 for maintaining mechanical and electrical connection between opposing track sections is shown. The connector 450, which is also in the form of an extension spring, includes hooked-shaped end sections 452, 454 and a resilient member or helical spring 460 therebetween. A finger 466, 468 extends downwardly from each respective end section 452, 454. Similar to the previous embodiment, the hook-shaped end-sections 452, 454 including the respective fingers 466, 468 are dimensioned to be received in the openings located on the track sections.

Regarding the above track connectors which include a resilient member made from an elastomeric material, preferably the elastomeric material offers a high degree of oil, ozone, UV, and weather resistance. The elastomeric material imparts a degree of flexibility to the track connector which is of advantage when the connected lengths of track are subject to expansion and/or contraction and the track connector is nevertheless expected neither to become loose nor to break.

The track connectors described herein can be used to connect any combination of sections of straight rail tracks, curved rail tracks, switch tracks and crossing tracks. Apart from the savings inherent in the fact that only one rail track connector need be provided, it is easier for a hobby enthusiast to use the model railway because different kinds of rail track sections can be connected together more quickly and remain together during operation and without posing problems. Moreover, the reduction in the number of parts that must be kept in stock is a convenience to manufacturers and retailers alike.

The present disclosure has been described with reference to several embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

What is claimed is:

1. An auxiliary model railroad track connector for adjoining associated railroad track sections, each associated railroad track section including an array of ties and a pair of rails positioned in a spaced apart relationship on the array of ties, the auxiliary model railroad track connector comprising:

a first end section and a second end section, the first and second end sections being coupled to opposing ties of the adjoining associated track sections; and a resilient member interposed between the first and second end sections, the resilient member having sufficient pulling force to hold and pull the associated adjoining track sections together, wherein the auxiliary connector prevents longitudinal movement between the adjoining associated railroad tracks sections and maintains mechanical and electrical connections between the associated railroad track sections.

2. The auxiliary connector of claim 1, wherein each of the first and second end sections includes an opening configured to receive a respective end portion of each opposing tie.

3. The auxiliary connector or claim 2, wherein at least one of the first and second end sections is generally rectangular in shape.

4. The auxiliary connector of claim 1, wherein at least one of the first and second end sections is generally hook-shaped.

5. The auxiliary connector of claim 1, wherein the resilient member is a closely wound helical spring having end sections connected to the respective first and second end sections.

6. The auxiliary connector of claim 5, wherein the helical spring defines a longitudinal center axis and the first and second end sections together define a common plane, the longitudinal center axis being offset from the common plane.

7. The auxiliary connector of claim 1, wherein the resilient member includes a side surface and the first and second end sections together define a common plane, the common plane being generally tangent to the side surface.

8. The auxiliary connector of claim 1, wherein the resilient member is a strap made from an elastomeric material, the strap having end sections connected to the respective first and second end sections.

9. The auxiliary connector of claim 1, wherein the resilient member includes a bottom surface, the bottom surface being located above a lowermost portion of each of the first and second end sections.

10. An auxiliary model railroad track connector for adjoining associated first and second opposing railroad track sections, each associated railroad track section including:

an array of ties, first and second rails positioned in a spaced apart relationship on the array of ties, and a rail joiner secured to an end of one of the first and second rails for aligning and joining the respective rails of the track sections, the auxiliary connector comprising:

a first end section and a second end section, the first end section being mounted one of the ties of the associated first track section and the second end section being mounted to an opposing tie of the associated second track section;

a resilient member interposed between and connected to the first and second end sections, the resilient member including a bottom surface, the bottom surface being located above a lowermost portion of each of the first and second end sections, wherein the auxiliary connector prevents longitudinal movement between the adjoining associated first and second railroad tracks sections and maintains mechanical and electrical connections between the associated first and second railroad track sections.

11. The auxiliary connector of claim 10, wherein the at least one of the first and second end section is generally rectangular in shape for receiving an end section of one of the ties of one of the associated first and second track sections.

12. The auxiliary connector of claim 10, wherein the first and second end sections are generally hook-shaped, the second end section being a mirror image of the first end section.

13. The auxiliary connector of claim 12, wherein at least one of the first and second end sections includes a downwardly projecting finger.

14. The auxiliary connector of claim 12, wherein at least one of the ties of one of the associated first and second track sections includes an opening, the hook-shaped ends section configured to engage the opening.

15. The auxiliary connector of claim 10, wherein the resilient member is one of a helical spring and an elastomeric strap.

* * * * *